United States Patent [19]

Mosch

[11] 4,021,948

[45] May 10, 1977

[54] FOLDABLE WARNING DEVICE

[76] Inventor: Alfred Mosch, 442 Poplar St., Bridgeport, Conn. 06605

[22] Filed: Aug. 26, 1976

[21] Appl. No.: 717,880

Related U.S. Application Data

[63] Continuation of Ser. No. 613,916, Sept. 16, 1975, abandoned, which is a continuation of Ser. No. 354,219, April 25, 1973, abandoned.

[52] U.S. Cl. ..... 40/129 C; 40/125 G

[51] Int. Cl.[2] ..... G09F 21/04

[58] Field of Search ..... 40/129 C, 129 R, 129 A, 40/129 B, 125 G

[56] References Cited

UNITED STATES PATENTS

| | | | |
|---|---|---|---|
| 1,436,854 | 11/1922 | Brady | 40/129 A |
| 1,720,531 | 7/1929 | Siegel | 40/129 B |
| 1,942,444 | 1/1934 | O'Connor | 40/129 C |
| 2,527,258 | 10/1950 | Kahn | 40/129 A |
| 3,255,725 | 6/1966 | Von Kreidner | 40/129 C |
| 3,461,584 | 8/1969 | Wilson | 40/129 C |
| 3,594,938 | 7/1971 | Mosch | 40/129 C |
| 3,670,438 | 6/1972 | Carroll | 40/129 C |

*Primary Examiner*—John F. Pitrelli
*Attorney, Agent, or Firm*—Ernest F. Marmorek

[57] ABSTRACT

A rectangular or trapezoidal or triangular warning sign of flexible sheet has attached near its upper corners a resilient mounting string. Each lower corner portion of the sheet is connected to one end of a string which, at the other end, is provided with a mounting hook.

1 Claim, 15 Drawing Figures

FIG.1
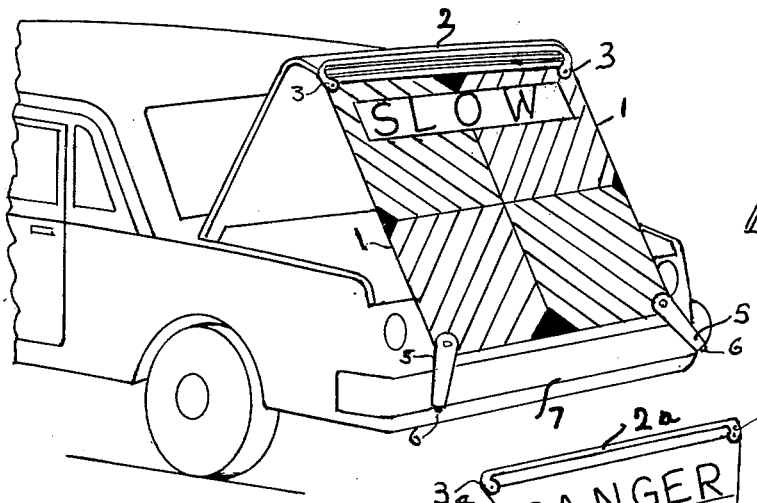
FIG.2
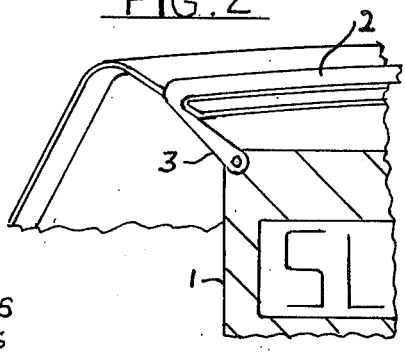
FIG.15
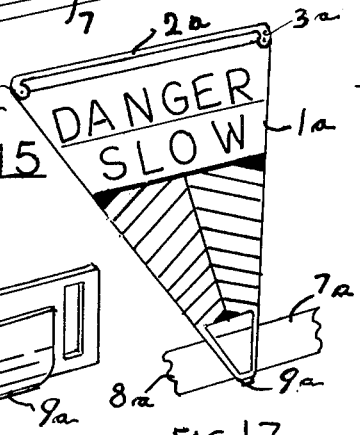
FIG.3
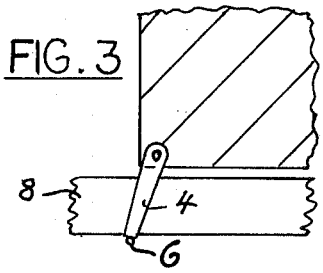
FIG.7
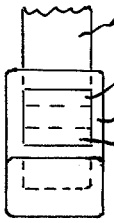
FIG.6
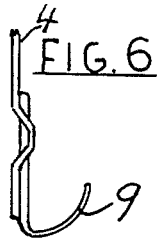
FIG.12
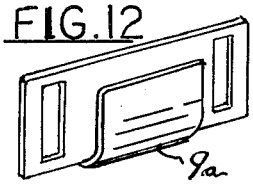
FIG.8
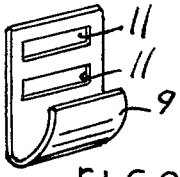
FIG.14
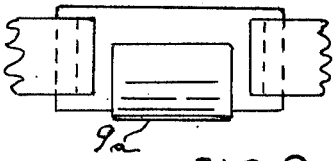
FIG.13
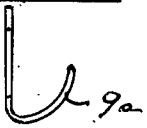
FIG.5
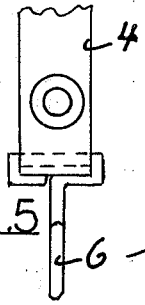
FIG.4
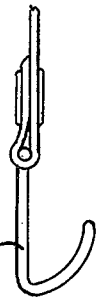
FIG.9
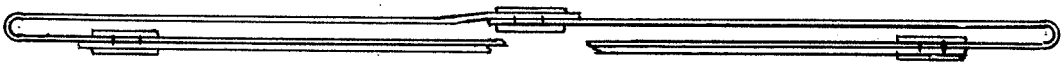
FIG.10
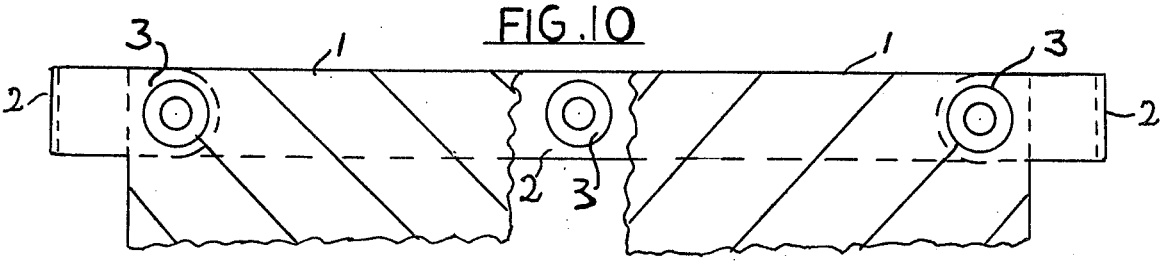
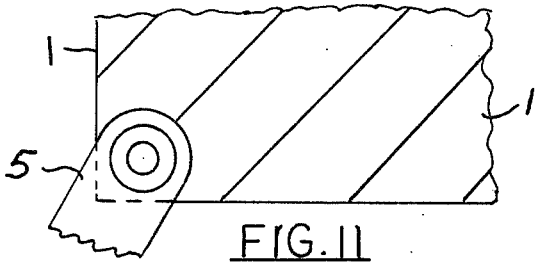
FIG.11

FOLDABLE WARNING DEVICE

This is a continuation of application Ser. No. 613,916, filed Sept. 16, 1975, now abandoned; which is a continuation of application Ser. No. 354,219 filed Apr. 25, 1973 abandoned.

CROSS REFERENCE TO RELATED APPLICATIONS

Reference is had to my application Ser. No. 741,970, filed July 2, 1968 for "Warning Device", now U.S. Pat. No. 3,594,938 and to my application Ser. No. 140,657, filed May 6, 1971 for "Warning Device".

BACKGROUND OF THE INVENTION

The invention relates generally to improvements in warning devices and relates particularly to a foldable safety warning device for use in connection with disabled motor vehicles. It has been already proposed how to make an inexpensive warning device which can be quickly connected to the rear of a motor vehicle and conveniently stored in the vehicle. A certain disadvantage, nonetheless, has still been felt due to the fact that such prior art signs could be folded or rolled-up along their reinforcing members only so that the folded sign had a relatively large length.

It is an object of this invention to remove the disadvantage of prior art of this type and to provide a warning device which is readily mountable on the disabled vehicle and which upon use can be folded into a compact package having a very small size.

SUMMARY OF THE INVENTION

According to this invention, the above object is attained by providing a substantially rectangular or triangular or trapezoidal warning sign made of a flexible sheet with upper and lower edge portions and adapted to be suspended from the disabled motor vehicle, an elongated first string or band of resilient material removably connected at the ends thereof near the ends of the upper edge portion of the sign and adapted to be connected to a part of the vehicle, a second string and a third string each being removably connected at one end thereof near respective ends of the lower edge portion of the sign, and a hook adapted to be connected to an outer part of the vehicle and being connected near the other ends of the second and third strings, respectively.

It is advantageous when the first string is divided about midway and joined by a snap fastener. It is also advantageous that the strings be removably connected to the sign sheet by snap fasteners and that the hooks be provided with buckles for adjusting the length of the strings.

BRIEF DESCRIPTION OF THE DRAWINGS

For a fuller understanding of the nature and objects of this invention, reference should be had to the following detailed description, taken in connection with the accompanying drawings in which:

FIG. 1 is a perspective view of the rear part of a motor vehicle having a displayed warning device of this invention attached between the open trunk cover and the bumper;

FIG. 2 is an enlarged framentary perspective view of the upper left side of the device of FIG. 1;

FIG. 3 is an enlarged framentary elevation view of the lower left side of the device of FIG. 1;

FIG. 4 is a side view of a hook attached to the free end of a short elastic band as shown in FIG. 3;

FIG. 5 is a front view of the hook of FIG. 4;

FIG. 6 is a side view of a flat hook member including a buckle for engaging the short elastic band;

FIG. 7 is a front view of the hook member of FIG. 6 in connection with the band;

FIG. 8 is a perspective view of the hook member of FIG. 6;

FIG. 9 is a framentary plane view of the warning device of this invention showing a divided and releasably connected upper string;

FIG. 10 is a cutaway front view of the upper part of the device as shown in FIG. 9;

FIG. 11 is a framentary view of the lower corner of the device of this invention showing releasable connection of the short string;

FIG. 12 is a perspective view of another modification of a hook with a buckle;

FIG. 13 is a side view of the hook of FIG. 12;

FIG. 14 is the hook of FIG. 12 in connection with the upper retaining string; and FIG. 15 is a modification of the shape of the flexible sheet in the device of this invention.

DETAILED DESCRIPTION

In the figures, like parts are designated by like numerals. Referring to FIG. 1, there is shown in overall display the warning device of this invention resiliently suspended on the edge of the open trunk cover of a disabled vehicle and hooked to the bumper by hooks attached to elastic bands.

The warning device includes a flexible sheet 1 carrying a warning sign. An elastic band is removably attached by snap buttons 3 to respective upper corners of the sheet 1. In the embodiment as shown in FIG. 1, the upper elastic band of string 2 is made as a single piece adjusted in length to the size of a trunk cover.

In another embodiment, as shown in FIG. 9, the elastic strap 2 is divided about midway and releasably joined by snap fasteners 3. This modification makes it possible to attach the sign 1 to any suitable part of the vehicle other than the trunk cover, such as opposite side window frames.

Two additional short elastic straps 4 are attached to the lower corners of the sign sheet 1, respectively, by snap fasteners 3, whereas the free end of each strap 4 which also may be provided with snap fasteners 3, forms a loop holding a hook 6 for attachment to a suitable part of the vehicle such as the lower edge 7 of a bumper 8 for example.

FIGS. 4 and 5 show the embodiment of the releasable connection between a simple hook 6 and the loop at the lower strap 4.

Shown in FIGS. 6 to 8 is another embodiment of the connection of a flat hooked buckle 9 having two slots 11 for receiving the free end of the lower strap 4. The hooked buckle 9 makes it possible that the strap 4 can be adjusted in its length.

FIGS. 9 to 11 illustrate in greater detail the disconnectable attachment of the upper and lower straps 2 and 4 in the corners of the sheet 1. As it has been mentioned above, the upper resilient string 2 is divided approximately about midway; when disconnected, the free ends of respective halves of the string 2 can be attached to partly open side windows of the vehicle.

A modified form of a hooked buckle 9*a* is shown in FIGS. 12 to 14. The buckle 9*a* is suitable for being attached to the upper band 2.

After the emergency has passed, the warning device can be easily removed from the vehicle and may now be folded into a very small package forming the accessory of the vehicle.

The snap fasteners 3 make it possible to attach to the sheet 1 separate warning signs, such as "Slow", "Danger" and the like, or to replace similar signs for warning signals in different languages and/or in different colors. In this manner, the warning sign can be accommodated for different countries or for different weather or light conditions. The sign may be painted, for example with a luminous paint and/or with a reflective paint.

FIG. 15 illustrates a triangular or trapezoidal shape of the flexible sheel 1*a* having a lower retaining string which is provided with a single hooked buckle 9*a* according to FIG. 12.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A foldable warning device, for use suspended between an open receptacle cover of a vehicle and a lower portion of the vehicle, comprising, in combination:

a trapezoidal shaped flexible sheet having first and second parallel edges, said first parallel edge being longer than said second parallel edge, and two angularly off-set side edges between said parallel edges completing the trapezoidal shape, a resilient elongated connector having two end portions, each removabley secured near opposite ends to said first parallel edge and operative to engage a portion of the open cover, whereby said first parallel edge may be resiliently and removably secured to the open cover;

two substantially equally long fastening straps, each connected to an end of said second parallel edge and each projecting along an extension of the respective side edge, said straps intersecting thereby completing an overall triangular shape with a downward pointing apex when the warning device is suspended on the vehicle, and a buckle hook secured to said straps at the intersection thereof and operative to be secured to the lower portion of the vehicle.

* * * * *